US006561757B2

(12) United States Patent
Burdgick et al.

(10) Patent No.: US 6,561,757 B2
(45) Date of Patent: May 13, 2003

(54) TURBINE VANE SEGMENT AND IMPINGEMENT INSERT CONFIGURATION FOR FAIL-SAFE IMPINGEMENT INSERT RETENTION

(75) Inventors: Steven Sebastian Burdgick, Schenectady, NY (US); Iain Robertson Kellock, Greenville, SC (US)

(73) Assignee: General Electric Company, Schenectady, NY (US)

( * ) Notice: Subject to any disclaimer, the term of this patent is extended or adjusted under 35 U.S.C. 154(b) by 0 days.

(21) Appl. No.: 09/682,195

(22) Filed: Aug. 3, 2001

(65) Prior Publication Data

US 2003/0026689 A1 Feb. 6, 2003

(51) Int. Cl.[7] ..... F01D 9/06
(52) U.S. Cl. ..... 415/115; 415/114; 416/96 A
(58) Field of Search ..... 415/114, 115, 415/116; 416/96 R, 96 A, 97 R

(56) References Cited

U.S. PATENT DOCUMENTS

| | | | | | |
|---|---|---|---|---|---|
| 5,145,315 | A | * | 9/1992 | North et al. | 415/115 |
| 5,609,466 | A | * | 3/1997 | North et al. | 415/115 |
| 5,634,766 | A | * | 6/1997 | Cunha et al. | 415/115 |
| 6,193,465 | B1 | * | 2/2001 | Liotta et al. | 416/96 A |
| 6,283,708 | B1 | * | 9/2001 | Zelesky | 416/97 R |
| 6,416,275 | B1 | * | 7/2002 | Itzel et al. | 415/116 |

FOREIGN PATENT DOCUMENTS

| | | | | |
|---|---|---|---|---|
| GB | 696558 | A | * 9/1953 | 415/114 |

OTHER PUBLICATIONS

"39th GE Turbine State–of–the–Art Technology Seminar", Tab 1, ""F"Technology—the First Half–Million Operating Hours", H.E. Miller, Aug. 1996.

"39th GE Turbine State–of–the–Art Technology Seminar", Tab 2, "GE Heavy–Duty Gas Turbine Performance Characteristics", F. J. Brooks, Aug. 1996.

"39th GE Turbine State–of–the–Art Technology Seminar", Tab 3, "9EC 50Hz 170–MW Class Gas Turbine", A. S. Arrao, Aug. 1996.

"39th GE Turbine State–of–the–Art Technology Seminar", Tab 4, "MWS6001F—An Advanced–Technology 70–MW Class 50/60 Hz Gas Turbine", Ramachandran et al., Aug. 1996.

"39th GE Turbine State–of–the–Art Technology Seminar", Tab 5, "Turbomachinery Technology Advances at Nuovo Pignone", Benvenuti et al., Aug. 1996.

"39th GE Turbine State–of–the–Art Technology Seminar", Tab 6, "GE Aeroderivative Gas Turbines—Design and Operating Features", M.W. Horner, Aug. 1996.

"39th GE Turbine State–of–the–Art Technology Seminar", Tab 7, "Advance Gas Turbine Materials and Coatings", P.W. Schilke, Aug. 1996.

"39th GE Turbine State–of–the–Art Technology Seminar", Tab 8, "Dry Low $NO_x$ Combustion Systems for GE Heavy–Duty Turbines", L. B. Davis, Aug. 1996.

"39th GE Turbine State–of–the–Art Technology Seminar", Tab 9, "GE Gas Turbine Combustion Flexibility", M. A. Davi, Aug. 1996.

"39th GE Turbine State–of–the–Art Technology Seminar", Tab 10, "Gas Fuel Clean–Up System Design Considerations for GE Heavy–Duty Gas Turbines", C. Wilkes, Aug. 1996.

(List continued on next page.)

*Primary Examiner*—Christopher Verdier
(74) *Attorney, Agent, or Firm*—Nixon & Vanderhye PC

(57) ABSTRACT

An impingement insert sleeve is provided that is adapted to be disposed in a coolant cavity defined through a stator vane. The insert has a generally open inlet end and first and second pairs of diametrically opposed side walls, and at least one fail-safe tab defined at a longitudinal end of the insert for limiting radial displacement of the insert with respect to the stator vane.

24 Claims, 6 Drawing Sheets

OTHER PUBLICATIONS

"39th GE Turbine State–of–the–Art Technology Seminar", Tab 11, "Integrated Control Systems for Advanced Combined Cycles", Chu et al., Aug. 1996.
"39th GE Turbine State–of–the–Art Technology Seminar", Tab 12, "Power Systems for the 21st Century "H" Gas Turbine Combined Cycles", Paul et al., Aug. 1996.
"39th GE Turbine State–of–the–Art Technology Seminar", Tab 13, "Clean Coal and Heavy Oil Technologies for Gas Turbines", D. M. Todd, Aug. 1996.
"39th GE Turbine State–of–the–Art Technology Seminar", Tab 14, "Gas Turbine Conversions, Modifications and Uprates Technology", Stuck et al., Aug. 1996.
"39th GE Turbine State–of–the–Art Technology Seminar", Tab 15, "Performance and Reliability Improvements for Heavy–Duty Gas Turbines," J. R. Johnston, Aug. 1996.
"39th GE Turbine State–of–the–Art Technology Seminar", Tab 16, "Gas Turbine Repair Technology", Crimi et al, Aug. 1996.
"39th GE Turbine State–of–the–Art Technology Seminar", Tab 17, "Heavy Duty Turbine Operating & Maintenance Considerations", R. F. Hoeft, Aug. 1996.
"39th GE Turbine State–of–the–Art Technology Seminar", Tab 18, "Gas Turbine Performance Monitoring and Testing", Schmitt et al., Aug. 1996.
"39th GE Turbine State–of–the–Art Technology Seminar", Tab 19, "Monitoring Service Delivery System and Diagnostics", Madej et al., Aug. 1996.
"39th GE Turbine State–of–the–Art Technology Seminar", Tab 20, "Steam Turbines for Large Power Applications", Reinker et al., Aug. 1996.
"39th GE Turbine State–of–the–Art Technology Seminar", Tab 21, "Steam Turbines for Ultrasupercritical Power Plants", Retzlaff et al., Aug. 1996.
"39th GE Turbine State–of–the–Art Technology Seminar", Tab 22, "Steam Turbine Sustained Efficiency", P. Schofield, Aug. 1996.
"39th GE Turbine State–of–the–Art Technology Seminar", Tab 23, "Recent Advances in Steam Turbines for Industrial and Cogeneration Applications", Leger et al., Aug. 1996.
"39th GE Turbine State–of–the–Art Technology Seminar", Tab 24, "Mechanical Drive Steam Turbines", D. R. Leger, Aug. 1996.
"39th GE Turbine State–of–the–Art Technology Seminar", Tab 25, "Steam Turbines for STAG™ Combined–Cycle Power Systems", M. Boss, Aug. 1996.
"39th GE Turbine State–of–the–Art Technology Seminar", Tab 26, "Cogeneration Application Considerations", Fisk et al., Aug. 1996.
"39th GE Turbine State–of–the–Art Technology Seminar", Tab 27, "Performance and Economic Considerations of Repowering Steam Power Plants", Stoll et al., Aug. 1996.
"39th GE Turbine State–of–the–Art Technology Seminar", Tab 28, "High–Power–Density™ Steam Turbine Design Evolution", J. H. Moore, Aug. 1996.
"39th GE Turbine State–of–the–Art Technology Seminar", Tab 29, "Advances in Steam Path Technologies", Cofer, IV, et al., Aug. 1996.
"39th GE Turbine State–of–the–Art Technology Seminar", Tab 30, "Upgradable Opportunities for Steam Turbines", D. R. Dreier, Jr., Aug. 1996.
"39th GE Turbine State–of–the–Art Technology Seminar", Tab 31, "Uprate Options for Industrial Turbines", R. C. Beck, Aug. 1996.
"39th GE Turbine State–of–the–Art Technology Seminar", Tab 32, "Thermal Performance Evaluation and Assessment of Steam Turbine Units", P. Albert, Aug. 1996.
"39th GE Turbine State–of–the–Art Technology Seminar", Tab 33, "Advances in Welding Repair Technology" J. F. Nolan, Aug. 1996.
"39th GE Turbine State–of–the–Art Technology Seminar", Tab 34, "Operation and Maintenance Strategies to Enhance Plant Profitability", MacGillivray et al., Aug. 1996.
"39th GE Turbine State–of–the–Art Technology Seminar", Tab 35, "Generator Insitu Inspections", D. Stanton.
"39th GE Turbine State–of–the–Art Technology Seminar", Tab 36, "Generator Upgrade and Rewind", Halpern et al., Aug. 1996.
"39th GE Turbine State–of–the–Art Technology Seminar", Tab 37, "GE Combined Cycle Product Line and Performance", Chase, et al., Aug. 1996.
"39th GE Turbine State–of–the–Art Technology Seminar", Tab 38, "GE Combined Cycle Experience", Maslak et al., Aug. 1996.
"39th GE Turbine State–of–the–Art Technology Seminar", Tab 39, "Single–Shaft Combined Cycle Power Generating Systems", Tomlinson et al., Aug. 1996.
"Advanced Turbine System Program—Conceptual Design and Product Development", Annual Report, Sep. 1, 1994–Aug. 31, 1995.
"Advanced Turbine Systems (ATS Program) Conceptual Design and Product Development", Final Technical Progress Report, vol. 2—Industrial Machine, Mar. 31, 1997, Morgantown,, WV.
"Advanced Turbine Systems (ATS Program), Conceptual Design and Product Development", Final Technical Progress Report, Aug. 31, 1996, Morgantown, WV.
"Advanced Turbine Systems (ATS) Program, Phase 2, Conceptual Design and Product Development", Yearly Technical Progress Report, Reporting Period: Aug. 25, 1993–Aug. 31, 1994.
"Advanced Turbine Systems" Annual Program Review, Preprints, Nov. 2–4, 1998, Washington, D.C. U.S. Department of Energy, Office of Industrial Technologies Federal Energy Technology Center.
"ATS Conference" Oct. 28, 1999, Slide Presentation.
"Baglan Bay Launch Site", various articles relating to Baglan Energy Park.
"Baglan Energy Park", Brochure.
"Commercialization", Del Williamson, Present, Global Sales, May 8, 1998.
"Environmental, Health and Safety Assessment: ATS 7H Program (Phase 3R) Test Activities at the GE Power Systems Gas Turbine Manufacturing Facility, Greenville, SC", Document #1753, Feb. 1998, Publication Date: Nov. 17, 1998, Report Nos. DE–FC21–95MC31176–11.
"Exhibit panels used at 1995 product introduction at PowerGen Europe".
"Extensive Testing Program Validates High Efficiency, reliability of GE's Advanced "H" Gas Turbine Technology", Press Information, Press Release, 96–NR14, Jun. 26, 1996, H Technology Tests/pp. 1–4.
"Extensive Testing Program Validates High Efficiency, Reliability of GE's Advanced "H" Gas Turbine Technology", GE Introduces Advanced Gas Turbine Technology Platform: First Reach 60% Combined–Cycle Power Plant Efficiency, Press Information, Press Release, Power–Gen Europe '95, 95–NRR15, Advanced Technology Introduction/pp. 1–6.

"Gas, Steam Turbine Work as Single Unit in GE's Advanced H Technology Combined–Cycle System", Press Information, Press Release, 95–NR18, May 16, 1995, Advanced Technology Introduction/pp. 1–3.
"GE Breaks 60% Net Efficiency Barrier" paper, 4 pages.
"GE Businesses Share Technologies and Experts to Develop State–of–the–Art Products", Press Information, Press Release 95–NR10, May 16, 1995, GE Technology Transfer/pp. 1–3.
"General Electric ATS Program Technical Review, Phase 2 Activities", T. Chance et al., pp. 1–4.
"General Electric's DOE/ATS H Gas Turbine Development" Advanced Turbine Systems Annual Review Meeting, Nov. 7–8, 1996, Washington, D.C., Publication Release.
"H Technology Commercialization", 1998 MarComm Activity Recommendation, Mar., 1998.
"H Technology", Jon Ebacher, VP, Power Gen Technology, May 8, 1998.
"H Testing Process", Jon Ebacher, VP, Power Gen Technology, May 8, 1998.
"Heavy Duty & Aeroderivative Products" Gas Turbines, Brochure, 1998.
"MS7001H/MS9001H Gas Turbine, gepower.com website for PowerGen Europe" Jun. 1–3 going public Jun. 15, (1995).
"New Steam Cooling System is a Key to 60% Efficiency For GE "H" Technology Combined–Cycle Systems", Press Information, Press Release, 95–NRR16, May 16, 1995, H Technology/pp. 1–3.
"Overview of GE's Gas Turbine Combined Cycle", Jul. 1, 1995 to Dec. 31, 1997.
"Power Systems for the 21$^{th}$ Century—"H" Gas Turbine Combined Cycles", Thomas C. Paul et al., Report.
"Power–Gen '96 Europe", Conference Programme, Budapest, Hungary, Jun. 26–28, 1996.
"Power–Gen International", 1998 Show Guide, Dec. 9–11, 1998, Orange County Convention Center, Orlando, Florida.
"Press Coverage following 1995 product announcement"; various newspaper clippings relating to improved generator.
"Proceedings of the Advanced Turbine Systems Annual Program Review Meeting", vol. I, "Industrial Advanced Turbine Systems Program Overview", D.W. Esbeck, p. 3–13, Oct., 1995.
"Proceedings of the Advanced Turbine Systems Annual Program Review Meeting", vol. I, "H Gas Turbine Combined Cycle", J. Corman, p. 14–21, Oct., 1995.
"Proceedings of the Advanced Turbine Systems Annual Program Review Meeting", vol. 1, "Overview of Westinghouse's Advanced Turbine Systems Program", Bannister et al., p. 22–20, Oct. 1995.
"Proceedings of the Advanced Turbine Systems Annual Program Review Meeting", vol. I, "Allison Engine ATS Program Technical Review", D. Mukavetz, p. 31–42, Oct., 1995.
"Proceedings of the Advanced Turbine Systems Annual Program Review Meeting", vol. I, "Advanced Turbine Systems Program Industrial System Concept Development", S. Gates, p. 43–63, Oct., 1995.
"Proceedings of the Advanced Turbine Systems Annual Program Review Meeting", vol. I, "Advanced Turbine System Program Phase 2 Cycle Selection", Latcovich, Jr., p. 64–69, Oct., 1995.
"Proceedings of the Advanced Turbine Systems Annual Program Review Meeting", vol. I, "General Electric ATS Program Technical Review Phase 2 Activities", Chance et al., p. 70–74, Oct., 1995.
"Proceedings of the Advanced Turbine Systems Annual Program Review Meeting", vol. I, "Technical Review of Westinghouse's Advanced Turbine Systems Program", Diakunchak et al., p. 75–86, Oct., 1995.
"Proceedings of the Advanced Turbine Systems Annual Program Review Meeting", vol. I, "Advanced Combustion Turbines and Cycles: An EPRI Perspective", Touchton et al., p. 87–88, Oct., 1995.
"Proceedings of the Advanced Turbine Systems Annual Program Review Meeting", vol. I, "Advanced Turbine Systems Annual Program Review", William E. Koop, p. 89–92, Oct., 1995.
"Proceedings of the Advanced Turbine Systems Annual Program Review Meeting", vol. I, "The AGTSR Consortium: An Update", Fant et al., p. 93–102, Oct., 1995.
"Proceedings of the Advanced Turbine Systems Annual Program Review Meeting", vol. I, "Overview of Allison/AGTSR Interactions", Sy A. Ali, p. 103–106, Oct., 1995.
"Proceedings of the Advanced Turbine Systems Annual Program Review Meeting", vol. I, "Design Factors for Stable Lean Premix Combustion", Richards et al., p. 107–113, Oct., 1995.
"Proceedings of the Advanced Turbine Systems Annual Program Review Meeting", vol. I, "Ceramic Stationary as Turbine", M. van Roode, p. 114–147, Oct., 1995.
"Proceedings of the Advanced Turbine Systems Annual Program Review Meeting", vol. I, "DOE/Allison Ceramic Vane Effort", Wenglarz et al., p. 148–151, Oct., 1995.
"Proceedings of the Advanced Turbine Systems Annual Program Review Meeting", vol. I, "Materials/Manufacturing Element of the Advanced Turbine Systems Program", Kamitz et al., p. 152–160, Oct., 1995.
"Proceedings of the Advanced Turbine Systems Annual Program Review Meeting", vol. I, "Land–Based Turbine Casting Intiative", Mueller et al., p. 161–170, Oct., 1995.
"Proceedings of the Advanced Turbine Systems Annual Program Review Meeting", vol. I, "Turbine Airfoil Manufacturing Technology", Kortovich, p. 171–181, Oct., 1995.
"Proceedings of the Advanced Turbine Systems Annual Program Review Meeting", vol. I, "Pratt & Whitney Thermal Barrier Coatings", Bornstein et al., p. 182–193, Oct., 1995.
"Proceedings of the Advanced Turbine Systems Annual Program Review Meeting", vol. I, "Westinhouse Thermal Barrier Coatings", Goedjen et al., p. 194–199, Oct., 1995.
"Proceedings of the Advanced Turbine Systems Annual Program Review Meeting", vol. I, "High Performance Steam Development", Duffy et al., p. 200–220, Oct., 1995.
"Proceedings of the Advanced Turbine Systems Annual Program Review Meeting", vol. II, "Lean Premixed Combustion Stabilized by Radiation Feedback and hetergeneous Catalysis", Dibble et al., p. 221–232, Oct., 1995.
"Proceedings of the Advanced Turbine Systems Annual Program Review Meeting", vol. II, Rayleigh/Raman/LIF Measurements in a Turbulent Lean Premixed Combustor, Nandula et al. p. 233–248, Oct., 1995.
"Proceedings of the Advanced Turbine Systems Annual Program Review Meeting", vol. II, "Lean Premixed Flames for Low $No_x$ Combustors", Sojka et al., p. 249–275, Oct., 1995.

"Proceedings of the Advanced Turbine Systems Annual Program Review Meeting", vol. II, "Functionally Gradient Materials for Thermal Barrier Coatings in Advanced Gas Turbine Systems", Banovic et al., p. 276–280, Oct., 1995.

"Proceedings of the Advanced Turbine Systems Annual Program Review Meeting", vol. II, "Advanced Turbine Cooling, Heat Transfer, and Aerodynamic Studies", Han et al., p. 281–309, Oct., 1995.

"Proceedings of the Advanced Turbine Systems Annual Program Review Meeting", vol. II, "Life Prediction of Advanced Materials for Gas Turbine Application", Zamrik et al., p. 310–327, Oct., 1995.

"Proceedings of the Advanced Turbine Systems Annual Program Review Meeting", vol. II, "Advanced Combustion Technologies for Gas Turbine Power Plants", Vandsburger et al., p. 328–352, Oct., 1995.

"Proceedings of the Advanced Turbine Systems Annual Program Review Meeting", vol. II, "Combustion Modeling in Advanced Gas Turbine Systems", Smoot et al., p. 353–370, Oct., 1995.

"Proceedings of the Advanced Turbine Systems Annual Program Review Meeting", vol. II, "Heat Transfer in a Two–Pass Internally Ribbed Turbine Blade Coolant Channel with Cylindrical Vortex Generators", Hibbs et al. p. 371–390, Oct., 1995.

"Proceedings of the Advanced Turbine Systems Annual Program Review Meeting", vol. II, "Rotational Effects on Turbine Blade Cooling", Govatzidakia et al., p. 391–392, Oct., 1995.

"Proceedings of the Advanced Turbine Systems Annual Program Review Meeting", "Advanced Turbine Systems Program Overview", David Esbeck, p. 27–34, Nov., 1996.

"Proceedings of the Advanced Turbine Systems Annual Program Review Meeting", Gerard McQuiggan, p.. 35–48, Nov., 1996.

"Proceedings of the Advanced Turbine Systems Annual Program Review Meeting", "Overview of GE's H Gas Turbine Combined Cycle", Cook et al., p. 49–72, Nov., 1996.

"Proceedings of the Advanced Turbine Systems Annual Program Review Meeting", "Allison Advanced Simple Cycle Gas Turbine System", William D. Weisbrod, p. 73–94, Nov., 1996.

"Proceedings of the Advanced Turbine Systems Annual Program Review Meeting", "The AGTSR Industry–University Consortium", Lawrence P. Golan,, p. 95–110, Nov., 1996.

"Proceedings of the Advanced Turbine Systems Annual Program Review Meeting", "$NO_x$ and CO Emissions Models for Gas–Fired Lean–Premixed Combustion Turbines", A. Mellor, p. 111–122, Nov., 1996.

"Proceedings of the Advanced Turbine Systems Annual Program Review Meeting", "Methodologies for Active Mixing and Combustion Control", Uri Vandsburger, p. 123–156, Nov., 1996.

"Proceedings of the Advanced Turbine Systems Annual Program Review Meeting", "Combustion Modeling in Advanced Gas Turbine Systems", Paul O. Hedman, p. 157–180, Nov., 19967.

"Proceedings of the Advanced Turbine Systems Annual Program Review Meeting", "Manifold Methods for Methane Combustion", Stephen B. Pope, p. 181–188, Nov., 1996.

"Proceedings of the Advanced Turbine Systems Annual Program Review Meeting", "The Role of Reactant Unmixedness, Strain Rate, and Length Scale on Premixed Combustor Performance", Scott Samuelsen, p. 189–210, Nov., 1996.

"Proceedings of the Advanced Turbine Systems Annual Program Review Meeting", "Effect of Swirl and Momentum Distribution on Temperance Distribution in Premixed Flames", Ashwani K. Gupta, p. 211–232, Nov., 1996.

"Proceedings of the Advanced Turbine Systems Annual Program Review Meeting", "Combustion Instability Studies Application to Land–Based Gas Turbine Combustors", Robert J. Santoro, p. 233–252.

"Proceedings of the Advanced Turbine Systems Annual Program Review Meeting", Active Control of Combustion Instabilities in Low $NO_x$ Turbines, Ben T. Zinn, p. 253–264, Nov., 1996.

"Proceedings of the Advanced Turbine Systems Annual Program Review Meeting", "Life Prediction of Advanced Materials for Gas Turbine Application," Sam Y. Zamrik, p. 265–274, Nov., 1996.

"Proceedings of the Advanced Turbine Systems Annual Program Review Meeting", "Combustion Chemical Vapor Deposited Coatings for Thermal Barrier Coating Systems", W. Brent Carter, p. 275–290, Nov., 1996.

"Proceedings of the Advanced Turbine Systems Annual Program Review Meeting", "Compatibility of Gas Turbine Materials with Steam Cooling", Vimai Desai, p. 291–314, Nov., 1996.

"Proceedings of the Advanced Turbine Systems Annual Program Review Meeting", "Bond Strength and Stress Measurements in Thermal Barrier Coatings", Maurice Gell, p. 315–334, Nov., 1996.

"Proceedings of the Advanced Turbine Systems Annual Program Review Meeting", "Advanced Multistage Turbine Blade Aerodynamics, Performance, Cooling and Heat Transfer", Sanford Fleeter, p. 335–356, Nov., 1996.

"Proceedings of the Advanced Turbine Systems Annual Program Review Meeting", "Flow Characteristics of an Intercooler System for Power Generating Gas Turbines", Ajay K. Agrawal, p. 357–370, Nov., 1996.

"Proceedings of the Advanced Turbine Systems Annual Program Review Meeting", "Improved Modeling Techniques for Turbomachinery Flow Fields", B. Lakshiminarayana, p. 371–392, Nov., 1996.

"Proceedings of the Advanced Turbine Systems Annual Program Review Meeting", "Development of an Advanced 3d & Viscous Aerodynamic Design Method for Turbomachine Components in Utility and Industrial Gas Turbine Applications", Thong Q. Dang, p. 393–406, Nov., 1996.

"Proceedings of the Advanced Turbine Systems Annual Program Review Meeting", "Advanced Turbine Cooling, Heat Transfer, and Aerodynamics Studies", Je–Chin Han, p. 407–426, Nov., 1996.

"Proceedings of the Advanced Turbine Systems Annual Program Review Meeting", vol. II, "Manifold Methods for Methane Combustion", Yang et al., p. 393–409, Oct., 1995.

"Proceedings of the Advanced Turbine Systems Annual Program Review Meeting", vol. II, "Advanced Multistage Turbine Blade Aerodynamics, Performance, Cooling, and Heat Transfer", Fleeter et al., p. 410–414, Oct., 1995.

"Proceedings of the Advanced Turbine Systems Annual Program Review Meeting, vol. II", The Role of Reactant Unmixedness, StrainRate, and Length Scale on Premixed Combustor Performance, Samuelsen et al., p. 415–422, Oct., 1995.

"Proceedings of the Advanced Turbine Systems Annual Program Review Meeting", vol. II, "Experimental and Computational Studies on Film Cooling With Compound Angle Injection", Goldstein et al., p. 423–451, Oct., 1995.

"Proceedings of the Advanced Turbine Systems Annual Program Review Meeting", vol. II, "Compatibility of Gas Turbine Materials with Steam Cooling", Desai et al., p. 452–464, Oct., 1995.

"Proceedings of the Advanced Turbine Systems Annual Program Review Meeting", vol. II, "Use of a Laser–Induced Fluorescence Thermal Imaging System for Film Cooling Heat Transfer Measurement", M. K. Chyu, p. 465–473, Oct., 1995.

"Proceedings of the Advanced Turbine Systems Annual Program Review Meeting", vol. II, Effects of Geometry on Slot–Jet Film Cooling Performance, Hyams et al., p. 474–496 Oct., 1995.

"Proceedings of the Advanced Turbine Systems Annual Program Review Meeting", vol. II, "Steam as Turbine Blade Coolant: Experimental Data Generation", Wilmsen et al., p. 497–505, Oct., 1995.

"Proceedings of the Advanced Turbine Systems Annual Program Review Meeting", vol. II, "Combustion Chemical Vapor Deposited Coatings for Thermal Barrier Coating Systems", Hampikian et al., p. 506–515, Oct., 1995.

"Proceedings of the Advanced Turbine Systems Annual Program Review Meeting", vol. II, "Premixed Burner Experiments: Geometry, Mixing, and Flame Structure Issues", Gupta et al., p. 516–528, Oct., 1995.

"Proceedings of the Advanced Turbine Systems Annual Program Review Meeting", vol. II, "Intercooler Flow Path for Gas Turbines: CFD Design and Experiments", Agrawal et al., p. 529–538, Oct., 1995.

"Proceedings of the Advanced Turbine Systems Annual Program Review Meeting", vol. II, "Bond Strength and Stress Measurements in Thermal Barrier Coatings", Gell et al., p. 539–549, Oct., 1995.

"Proceedings of the Advanced Turbine Systems Annual Program Review Meeting", "Active Control of Combustion Stabilities in Low $NO_x$ Gas Turbines", Zinn et al., p. 550–551, Oct., 1995.

"Proceedings of the Advanced Turbine Systems Annual Program Review Meeting", vol. II, "Combustion Instability Modeling and Analysis", Santoro et al., p. 552–559, Oct., 1995.

"Proceedings of the Advanced Turbine Systems Annual Program Review Meeting", vol. II, "Flow and Heat Transfer in Gas Turbine Disk Cavities to Nonuniform External Pressure Field", Roy et al., p. 560–565, Oct., 1995.

"Proceedings of the Advanced Turbine Systems Annual Program Review Meeting", vol. II, "Heat Pipe Turbine Vane Cooling", Langston et al., p. 566–572, Oct., 1995.

"Proceedings of the Advanced Turbine Systems Annual Program Review Meeting", vol. II, "Improved Modeling Techniques for Turbomachinery Flow Fields", Lakshimarayana et al., p. 573–581, Oct., 1995.

"Proceedings of the Advanced Turbine Systems Annual Program Review Meeting", vol. II, "Advanced 3D Inverse Method for Designing Turbomachinery Blades", T. Dang, p. 582, Oct., 1995.

"Proceedings of the Advanced Turbine Systems Annual Program Review Meeting", "ATS and the Industries of the Future", Denise Swink, p. 1, Nov., 1996.

"Proceedings of the Advanced Turbine Systems Annual Program Review Meeting", "Gas Turbine Association Agenda", William H. Day, p. 3–16, Nov., 1996.

"Proceedings of the Advanced Turbine Systems Annual Program Review Meeting", "Power Needs in the Chemical Industry", Keith Davidson, p. 17–26, Nov., 1996.

"Proceedings of the Advanced Turbine Systems Annual Program Review Meeting", "Heat Transfer in a Two–Pass Internally Ribbed Turbine Blade Coolant Channel with Vortex Generators", S. Acharya, p. 427–446.

"Proceedings of the Advanced Turbine Systems Annual Program Review Meeting", "Experimental and Computational Studies of Film Cooling with Compound Angle Injection", R. Goldstein, p. 447–460, Nov., 1996.

"Proceedings of the Advanced Turbine Systems Annual Program Review Meeting", "Study of Endwall Film Cooling with a Gap Leakage Using a Thermographic Phosphor Fluorescence Imaging System", Mingking K. Chyu, p. 461–470, Nov., 1996.

"Proceedings of the Advanced Turbine Systems Annual Program Review Meeting", "Steam as a Turbine Blade Coolant: External Side Heat Transfer", Abraham Engeda, p. 471–482, Nov., 1996.

"Proceedings of the Advanced Turbine Systems Annual Program Review Meeting", "Flow and Heat Transfer in Gas Turbine Disk Cavities Subject to Nonuniform External Pressure Field", Ramendra Roy, p. 483–498, Nov., 1996.

"Proceedings of the Advanced Turbine Systems Annual Program Review Meeting", "Closed–Loop Mist/Steam Cooling for Advanced Turbine Systems", Ting Wang, p. 499–512, Nov., 1996.

"Proceedings of the Advanced Turbine Systems Annual Program Review Meeting", "Heat Pipe Turbine Vane Cooling", Langston et al., p. 513–534, Nov., 1996.

"Proceedings of the Advanced Turbine Systems Annual Program Review Meeting", "EPRI's Combustion Turbine Program: Status and Future Directions", Arthur Cohn, p. 535,–552 Nov., 1996.

"Proceedings of the Advanced Turbine Systems Annual Program Review Meeting", "ATS Materials Support", Michael Kamitz, p. 553–576, Nov., 1996.

"Proceedings of the Advanced Systems Annual Program Review Meeting", "Land Based Turbine Casting Initiative", Boyd A. Mueller, p. 577–592, Nov., 1996.

"Proceedings of the Advanced Turbine Systems Annual Program Review Meeting", "Turbine Airfoil Manufacturing Technology", Charles S. Kortovich, p. 593–622, Nov., 1996.

"Proceedings of the Advanced Turbine Systems Annual Program Review Meeting", "Hot Corrosion Testing of TBS's", Norman Bornstein, p. 623–631, Nov., 1996.

"Proceedings of the Advanced Turbine Systems Annual Program Review Meeting", "Ceramic Stationary Gas Turbine", Mark van Roode, p. 633–658, Nov., 1996.

"Proceedings of the Advanced Turbine Systems Annual Program Review Meeting", "Western European Status of Ceramics for Gas Turbines", Tibor Bornemisza, p. 659–670, Nov., 1996.

"Proceedings of the Advanced Turbine Systems Annual Program Review Meeting", S"tatus of Ceramic Gas Turbines in Russia", Mark van Roode, p. 671, Nov., 1996.
"Status Report: The U.S. Department of Energy's Advanced Turbine systems Program", facsimile dated Nov. 7, 1996.
"Testing Program Results Validate GE's H Gas Turbine—High Efficiency, Low Cost of Electricity and Low Emissions", Roger Schonewald and Patrick Marolda, (no date available).
"Testing Program Results Validate GE's H Gas Turbine—High Efficiency, Low Cost of Electricity and Low Emissions", Slide Presentation—working draft, (no date available).
"The Next Step in H . . . For Low Cost Per kW–Hour Power Generation", LP–1 PGE '98.
"Utility Advanced Turbine System (ATS) Technology Readiness Testing and Pre–Commercialization Demonstration", Document #486040, Oct. 1–Dec. 31, 1996, Publication Date, Jun. 1, 1997, Report Nos. DOE/MC/31176–5628.
"Utility Advanced Turbine System (ATS) Technology Readiness Testing—Phase 3", Document #666274, Oct. 1, 1996–Sep. 30, 1997, Publication Date, Dec. 31, 1997, Report Nos. DOE/MC/31176–10.
"Utility Advanced Turbine System (ATS) Technology Readiness Testing and Pre–Commercial Demonstration, Phase 3", Document #486029, Oct. 1–Dec. 31, 1995, Publication Date, May 1, 1997, Report Nos. DOE/MC/31176–5340.
"Utility Advanced Turbine System (ATS) Technology Readiness Testing and Pre–Commercial Demonstration—Phase 3", Document #486132, Apr. 1–Jun. 30, 1976, Publication Date, Dec. 31, 1996, Report Nos. DOE/MC/31176–5660.
"Utility Advanced Turbine System (ATS) Technology Readiness Testing and Pre–Commercial Demonstration—Phase 3", Document #587906, Jul. 1–Sep. 30, 1995, Publication Date, Dec. 31, 1995, Report Nos. DOE/MC/31176–5339.
"Utility Advanced Turbine System (ATS) Technology Readiness Testing and Pre–Commercial Demonstration" Document #666277, Apr. 1–Jun. 30, 1997, Publication Date, Dec. 31, 1997, Report Nos. DOE/MC/31176–8.
"Utility Advanced Turbine System (ATS) Technology Readiness Testing and Pre–Commercialization Demonstration" Jan. 1–Mar. 31, 1996, DOE/MC/31176–5338.
"Utility Advanced Turbine System (ATS) Technology Readiness Testing: Phase 3R", Document #756552, Apr. 1–Jun. 30, 1999, Publication Date, Sep. 1, 1999, Report Nos. DE–FC21–95MC31176–23.
"Utility Advanced Turbine System (ATS) Technology Readiness Testing:"Document #656823, Jan. 1–Mar. 31, 1998, Publication Date, Aug. 1, 1998, Report Nos. DOE/MC/31176–17.
"Utility Advanced Turbine Systems (ATS) Technology Readiness Testing and Pre–Commercial Demonstration", Annual Technical Progress Report, Reporting Period: Jul. 1, 1995–Sep. 30, 1996.
"Utility Advanced Turbine Systems (ATS) Technology Readiness Testing", Phase 3R, Annual Technical Progress Report, Reporting Period: Oct. 1, 1997–Sep. 30, 1998.
"Utility Advanced Turbine Systems (ATS) Technology Readiness Testing", Document#750405, Oct. 1–Dec. 30, 1998, Publication Date: May 1, 1999, Report Nos. DE–FC21–95MC31176–20.
"Utility Advanced Turbine Systems (ATS) Technology Readiness Testing", Document #1348, Apr. 1–Jun. 29, 1998, Publication Date Oct. 29, 1998, Report Nos. DE–FC21–95MC31176–18.
"Utility Advanced Turbine Systems (ATS) Technology Readiness Testing—Phase 3", Annual Technical Progress Report, Reporting Period: Oct. 1, 1996–Sep. 30, 1997.
"Utility Advanced Turbine Systems (ATS) Technology Readiness Testing and Pre–Commercial Demonstration", Quarterly Report, Jan. 1–Mar. 31, 1997, Document #666275, Report Nos. DOE/MC/31176–07.
"Proceedings of the 1997 Advanced Turbine Systems", Annual Program Review Meeting, Oct. 28–29, 1997.

* cited by examiner

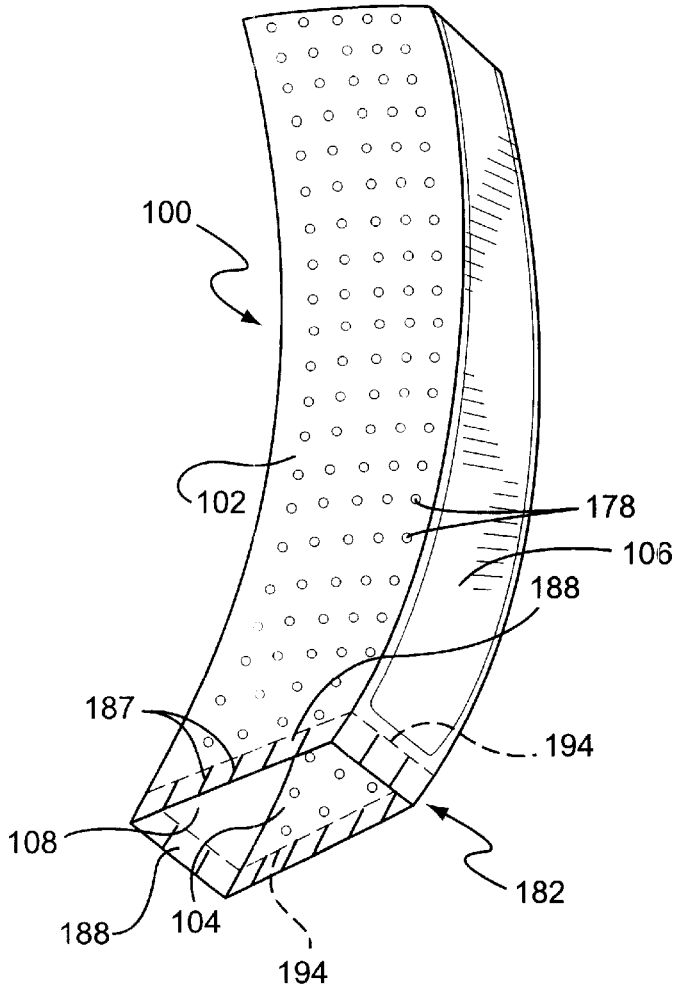
FIG. 4
FIG. 5
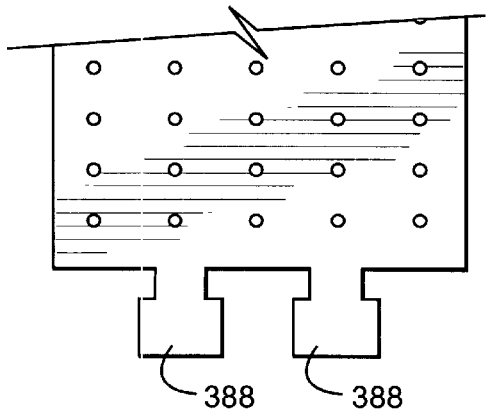

TURBINE VANE SEGMENT AND IMPINGEMENT INSERT CONFIGURATION FOR FAIL-SAFE IMPINGEMENT INSERT RETENTION

FEDERAL RESEARCH STATEMENT

The Government may have certain rights in this invention pursuant to Contract No. DE-FC21-95MC31176 awarded by the U.S. Department of Energy.

BACKGROUND OF INVENTION

The present invention relates generally to cooling gas turbines that are used, for example, for electrical power generation and, more particularly, to the impingement insert to nozzle connection in such gas turbines.

The traditional approach for cooling turbine blades and nozzles is to use high pressure cooling air extracted from a source, such as from the intermediate and last stages of the turbine compressor. A series of internal flow passages are typically used to achieve the desired mass flow objectives for cooling the turbine blades. A combination of external piping and/or internal flow passages are generally used to supply air to the nozzles, with the air typically exiting into the hot gas stream of the turbine to provide air film cooling of the nozzle surface.

In advanced gas turbine designs, improvements in efficiency and reductions in emission can be realized by closed-loop cooling of the hot gas path parts (nozzles, buckets and shrouds). Steam has been demonstrated to be a preferred media for cooling gas turbine nozzles (stator vanes) particularly for combined cycle plants. See for example, U.S. Pat. No. 5,253,976, the disclosure of which is incorporated herein by this reference. However, because steam has a higher heat capacity than the combustion gas, it is inefficient to allow the coolant steam to mix with the hot gas stream. Consequently, it is desirable to maintain cooling steam inside the hot gas path components in a closed circuit. Certain areas of the components of the hot gas path, however, cannot practically be cooled with steam in a closed circuit. For example, the relatively thin structure of the trailing edges of the nozzle vanes effectively precludes steam cooling of those edges. Therefore, air cooling may be provided in the trailing edges of nozzle vanes. For a complete description of the steam cooled nozzles with air cooling along the trailing edge, reference is made to U.S. Pat. No. 5,634,766, the disclosure of which is incorporated herein by reference.

In turbine nozzles there are typically impingement inserts disposed inside the nozzle cavities to augment heat transfer coefficients and, therefore, increase cooling of the airfoil walls. The connection of the impingement insert to the nozzle is a difficult task, particularly in closed circuit, steam cooled gas turbine nozzles. While it is desirable for a large physical area to define the connection of the impingement insert to the nozzle, it is not possible to effectively cool such a large area. Therefore, the goal is to minimize the connected area while still maintaining enough strength in the joint. If the joint, which may be for example a braze or weld, should fail, there is no positive retention of the insert. If the joint fails, this would result in a bypass of the cooling circuit, and would cause considerable damage to the nozzle due to the high gas path temperature to which the nozzle is exposed.

Previous designs using air cooling of the airfoil typically retain the inserts using a collar at the end of the insert that attaches to a rib extending radially off the nozzle side wall. Steam cooled (closed circuit) designs may be recessed slightly into the airfoil cavities so that an internal rib, also known as a flash rib, is provided in the cavity for insert attachment. As can be appreciated, recessing the insert into the nozzle airfoil and creating a joint at this internal rib causes difficulty in positive retention in the case of a joint failure. Indeed, no retention radially of the nozzle is provided.

SUMMARY OF INVENTION

The present invention provides a cooling system for cooling the hot gas components of a nozzle stage of a gas turbine, in which closed circuit steam or air cooling and/or open circuit air cooling systems may be employed. In the closed circuit system, a plurality of nozzle vane segments are provided, each of which comprises one or more nozzle vanes extending between inner and outer walls. The vanes have a plurality of cavities in communication with compartments in the outer and inner walls for flowing cooling media in a closed circuit for cooling the outer and inner walls and the vanes per se. This closed circuit cooling system is substantially similar, structurally, to the steam cooling system described and illustrated in the prior referenced U.S. Pat. No. 5,634,766, with certain exceptions as noted below. Thus, cooling media is provided to a plenum in the outer wall of the segment for distribution therein and passage through impingement openings in a plate for impingement cooling of the outer wall surface of the segment. The spent impingement cooling media flows into leading edge and aft cavities extending radially through the vane. Return intermediate cooling. cavities extend radially and lie between the leading edge and aft cavities. A separate trailing edge cavity may also be provided.

The cooling media that flows through the leading edge and aft cavities flows into a plenum in the inner wall and through impingement openings in an impingement plate for impingement cooling of the inner wall of the segment. The spent impingement cooling media then flows through the intermediate return cavities for further cooling of the vane.

Impingement cooling is typically provided in the leading and aft cavities of the nozzle vane, as well as in the intermediate, return cavities of the vane. More specifically, impingement inserts are disposed inside the nozzle cavities to augment heat transfer coefficients and, therefore, increase cooling of the airfoil walls. The inserts in the leading and aft cavities comprise sleeves that are connected to integrally cast flanges in the outer wall of the cavities and extend through the cavities spaced from the walls thereof. The inserts have impingement holes in opposition to the walls of the cavity whereby cooling media, e.g. steam, flowing into the inserts flows outwardly through the impingement holes for impingement cooling of the vane walls. Return or exit channels may be provided along the inserts for channeling the spent impingement cooling media. Similarly, inserts in the return, intermediate cavities have impingement openings for flowing impingement cooling medium against the side walls of the vane. These inserts also may have return or exit channels for collecting the spent impingement cooling media and conducting it to the cooling media outlet.

As mentioned above, when the insert is recessed into the nozzle airfoil, particularly in the case of a closed circuit cooled nozzle where the joint is created at an internal rib, there is difficulty in positive retention in the case of a joint failure. Thus, the invention provides for positive retention of the insert in the case of joint failure. This retention is achieved by fail-safe tabs and/or standoffs at or adjacent the end of the insert. Fail-safe tabs may be provided as an integral part of the insert structure, and one or more of those tabs may be bent over after assembly to define a retention tab, and brazed in place if desired. The retention/bent-over tabs may be provided to overlie the radial rib and/or the internal rib. It is preferred, however, that the retention tabs be provided only at the radial rib locations for improved cooling, such as to maintain unobstructed cooling of the internal rib connection. In addition or in the alternative to standoffs provided as an integral part of the insert structure, standoffs may be provided to extend off of the adjacent nozzle sidewall cover or impingement plate.

Typically nozzles do not have metering plates as a part of the impingement insert design. Of the known designs using inserted metering plates, the metering plate is placed on and connected to the top of the insert. As used herein, 'top of the insert' refers to the entrance end or inlet end of the insert with respect to the direction of coolant flow therethrough. Thus, intermediate inserts through which coolant flow flows radially outwardly would have a metering plate, if provided, disposed at a radially inner end thereof.

In a second embodiment of the invention, rather than or in addition to providing local tabs and/or standoffs, on one or both ends of the nozzle, an end metering plate is provided that projects laterally beyond the insert so as to overlie the internal rib. The projecting portion of the metering plate thus defines a retention tab(s) for outboard retention whereas inboard displacement limits may be provided by a local standoff projection from the insert and/or the sidewall impingement plate, if provided, or sidewall cover.

Accordingly, the invention is embodied in an impingement insert sleeve for being disposed in a coolant cavity defined through a stator vane, having a generally open inlet end and first and second diametrically opposed, perforated side walls and having at least one tab defined at at least one longitudinal end of the insert for limiting radial displacement of the insert with respect to the vane. In one embodiment, at least one tab is disposed on and extends in a radial direction from an end edge of a main body of the insert, parallel to a longitudinal axis of the insert, for abutting a component facing thereto to limit radial displacement of the insert. In addition or in the alternative, at least one tab projects in a direction generally transverse to a longitudinal axis of the insert.

The invention may also be embodied in a turbine vane segment comprising inner and outer walls spaced from one another; a vane extending between the inner and outer walls and having leading and trailing edges, the vane including a plurality of discrete cavities between the leading and trailing edges and extending lengthwise of the vane for flowing a cooling medium; an insert sleeve within one cavity and spaced from interior wall surfaces thereof, the insert sleeve having an inlet end through which cooling medium flows into the insert sleeve; the insert sleeve having a plurality of openings therethrough for flowing the cooling medium through the openings into the space between the sleeve and the interior wall surfaces for impingement against the interior wall surface of the vane; and at least one tab defined at at least one longitudinal end of the insert for limiting radial displacement of the insert with respect to the vane.

In another embodiment of the invention, an impingement insert sleeve is provided for being disposed in a coolant cavity defined through a stator vane, the insert sleeve having an inlet end, first and second diametrically opposed, perforated side walls, a collar mounted to the inlet end, and a metering plate having at least one opening for cooling medium flow defined therethrough, the metering plate being mounted to the inlet end of the insert sleeve and including a portion projecting laterally beyond an outer periphery of the insert and the collar. The insert sleeve may further comprise at least one standoff tab projecting radially from a surface of the metering plate, for abutting engagement with an adjacent structure to limit radial displacement of the insert sleeve.

The invention may also be embodied in a turbine vane segment comprising inner and outer walls spaced from one another; a vane extending between the inner and outer walls and having leading and trailing edges, the vane including a plurality of discrete cavities between the leading and trailing edges and extending lengthwise of the vane for flowing a cooling medium; an insert sleeve within one cavity and spaced from interior wall surfaces thereof, the insert sleeve having an inlet end through which cooling medium flows into the insert sleeve, the insert sleeve having a plurality of openings therethrough for flowing the cooling medium through the openings into the space between the sleeve and the interior wall surfaces for impingement against the interior wall surface of the vane; an internal rib being defined about at least a portion of a periphery of the cavity, the insert being mounted to the internal rib by a braze or weld joint; and a metering plate having at least one opening for cooling medium flow defined therethrough, the metering plate being mounted to the inlet end of the insert sleeve and projecting laterally beyond an outer periphery of the insert so as to at least partially overlie the internal rib, whereby radial displacement of the insert with respect to the vane in the event of joint failure is substantially limited.

BRIEF DESCRIPTION OF DRAWINGS

These, as well as other objects and advantages of this invention, will be more completely understood and appreciated by careful study of the following more detailed description of the presently preferred exemplary embodiments of the invention taken in conjunction with the accompanying drawings, in which:

FIG. 4 is a perspective view of an impingement insert embodying the invention;

FIG. 5 is a schematic elevational view of an exemplary a fail-safe tab configuration;

DETAILED DESCRIPTION

As discussed previously, the present invention relates in particular to cooling circuits for the first stage nozzles of a turbine, reference being made to the previously identified patents for disclosures of various other aspects of the turbine, its construction and methods of operation.

Figure 1:
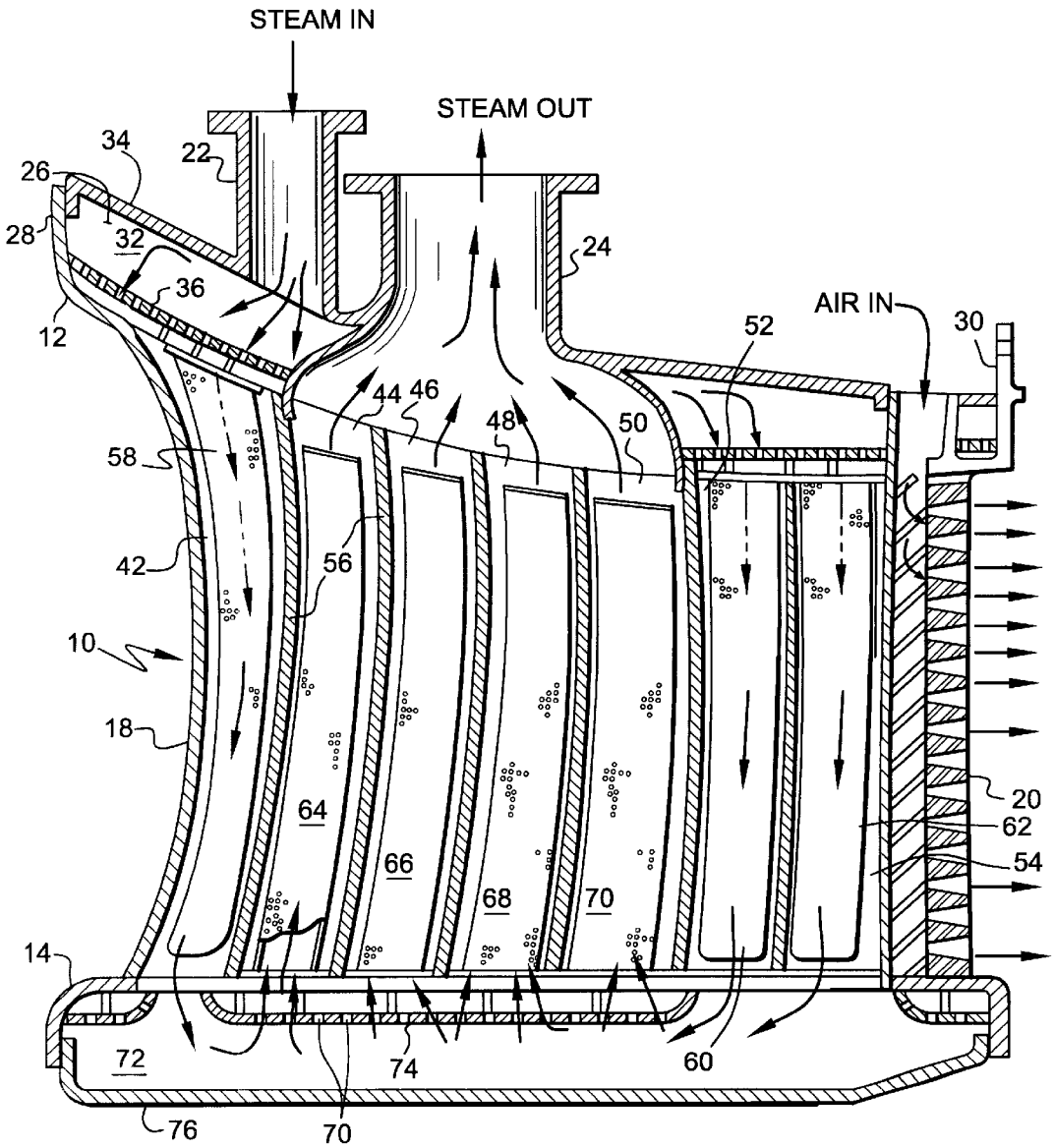
FIG. 1 is a schematic, cross-sectional view of an exemplary first stage nozzle vane.

Referring now to FIG. 1, there is schematically illustrated in cross-section a vane 10 comprising one of the plurality of circumferentially arranged segments of the first stage nozzle. It will be appreciated that the segments are positioned one to the other to form an annular array of segments defining the hot gas path through the first stage nozzle of the turbine. Each segment includes radially spaced outer and inner walls 12 and 14, respectively, with one or more nozzle vanes 10 extending between the outer and inner walls. The segments are supported about the turbine (not shown) with adjoining segments being sealed one to the other in a conventional manner. For purposes of this description, the vane 10 will be described as forming the sole vane of a segment.

As shown in a schematic illustration of FIG. 1, the vane has a leading edge 18, a trailing edge 20, an outer wall 12 and an inner wall 14. The outer wall includes outer side rails 26, a leading rail 28 and a trailing rail 30 that define a plenum 32 with outer cover plate 34. An impingement plate 36 is disposed generally in parallel to the outer wall for impingement cooling of the outer wall. It is to be noted that the terms outwardly and inwardly or outer and inner as used herein refer to the generally radial direction.

Figure 2:
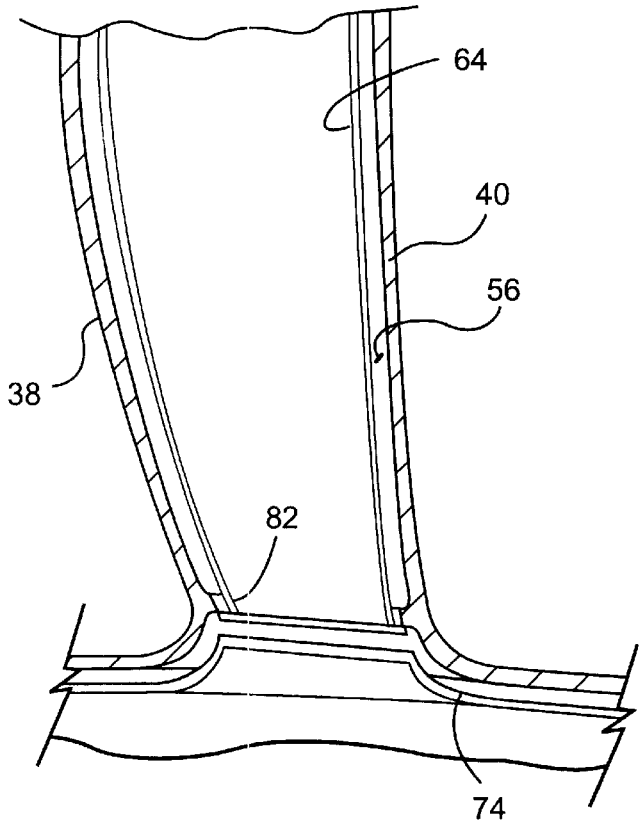
FIG. 2 (Prior Art)
FIG. 2 is a schematic cross sectional view showing an impingement insert disposed within a nozzle cavity and having a metering plate connected in a conventional manner to an inlet end thereof.
Figure 3:
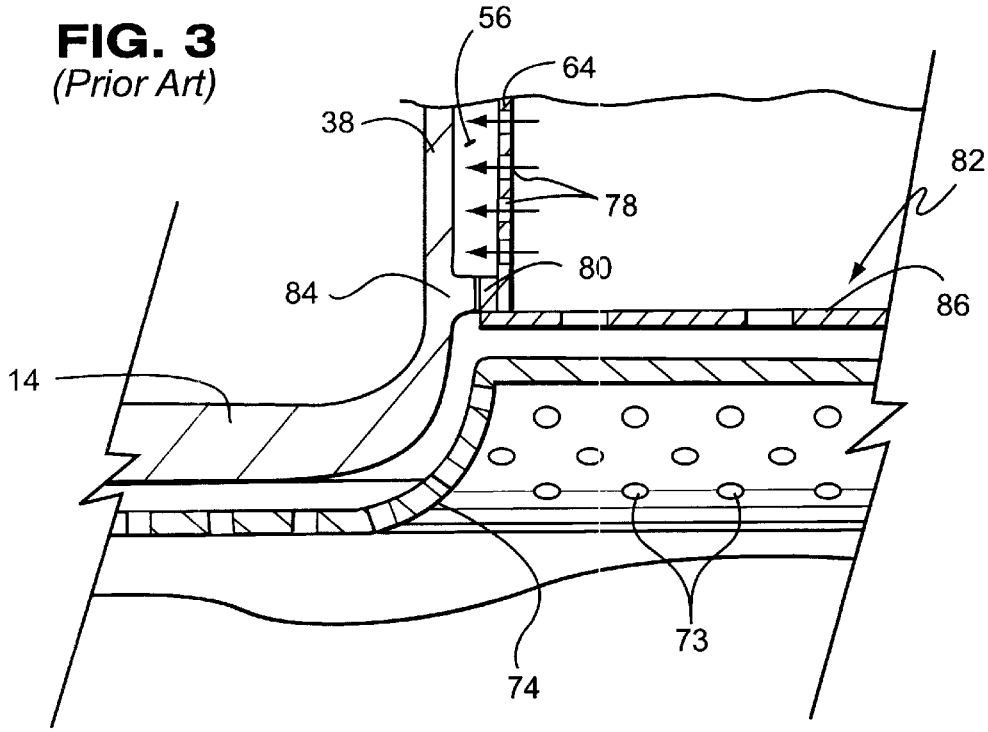
FIG. 3 (Prior Art)
FIG. 3 is a schematic cross-sectional view illustrating a conventional end connection of the metering plate.

In this example, the nozzle vane has a plurality of cavities, for example, a leading edge cavity 42, aft cavities 52, 54 and a plurality of intermediate return cavities 44, 46, 48, 50. Impingement inserts 58, 60, 62, 64, 66, 68, 70 are disposed respectively in the leading edge cavity 42, aft cavities 52, 54 and intermediate return cavities 44, 46, 48, 50. Thus, the cooling medium, such as steam, flows in through a steam inlet 22, through impingement plate 36 to impingement cool the outer wall 12 and then flows radially inwardly through, e.g., the leading edge cavity 42 and aft cavities 52, 54. The post impingement cooling media flows into a plenum 72 defined by the inner wall 14 and a lower cover plate 76. Radially inwardly of the inner wall is an impingement plate 74 (FIGS. 2–3). As a consequence, it will be appreciated that spent impingement cooling steam flows through the impingement openings 73 of the impingement plate 74 for impingement cooling of the inner wall 14. The spent cooling medium then flows towards the openings of the intermediate cavities for return flow to a steam outlet 24.

In FIGS. 2 and 3, a single insert disposed in a single cavity is illustrated. By way of non-limiting example, insert 64 disposed in cavity 44 is schematically shown. In a conventional manner, the insert sleeve 64 is disposed in the cavity 44 in spaced relation to the side walls 38, 40 and radial wall(s) 56 (FIG. 1) defining the respective cavity. The impingement openings 78 lie on opposite sides of the insert for flowing the cooling medium, e.g., steam, from within the insert sleeve through the impingement openings for impingement cooling of the side walls 38,40 of the vane, generally as discussed above. The spent cooling steam then flows through the gaps between the insert sleeve and the walls of the cavity to the outlet 24 for return to the coolant supply.

As mentioned above, typically nozzles do not have a metering plate as a part of the impingement insert design. Of the known designs using insert metering plates, the metering plate 86 is provided on the inlet end 82 of the insert. This is either done when the insert 64 is assembled, or as a part of the nozzle to insert assembly. Thus, as illustrated in FIGS. 2 and 3, to secure the impingement insert in the nozzle cavity, an insert collar 80 is conventionally provided peripherally of the opening at the inlet end 82 of the impingement insert at the interface of the impingement insert and the internal rib 84 of the nozzle airfoil wall. The insert collar 80 is secured to the internal rib 84 by a brazed or welded connection.

As noted above, inserts for closed circuit steam cooled nozzles are typically recessed and it is advantageous to minimize the attachment area at the nozzle internal rib to facilitate cooling in this region. Where a minimal attachment area is defined at the nozzle/rib, additional retention structures would be advantageous to provide positive retention in the case of joint failure.

In an embodiment of the invention, fail-safe tab(s) 188 defined as local retention tab(s) 190,290 and/or standoff(s) 192, 292 are provided on one or both longitudinal ends of the insert, only one end of a cavity insert of the nozzle being illustrated in FIGS. 4–8 by way of example. As used herein, a retention tab is a structure or component defined or provided on the insert at or adjacent an end thereof, and disposed transverse, for example, at an angle of about 90 degrees, to the longitudinal axis of the insert so as to engage a radial surface of the internal rib 184,284 and/or a radial surface of the radial rib 156, 256, to limit radial displacement of the insert with respect to the internal rib and/or radial rib, particularly in the event of insert to internal rib joint failure. As used herein a standoff is a structure or component defined or provided on the insert adjacent an end thereof, and/or a structure or component defined or provided on a structure radially adjacent the end of the insert, such as the adjacent impingement plate or cover, that will limit radial displacement of the insert toward the radially adjacent structure.

A first embodiment of the invention is illustrated in particular in FIGS. 4 and 6–8. To facilitate an understanding of this assembly, reference numbers generally corresponding to those described above and used in FIGS. 1–3 are used in FIGS. 4 and 6–8, but incremented by 100. In this embodiment the metering plate is either omitted or is recessed, that is placed downstream of the impingement insert inlet end 182, as shown at 186, and as described, for example, in U.S. Pat. No. 5,416,275.

As shown in FIG. 4, in this embodiment, the fail-safe tabs 188 are integrally formed with the wall(s) of insert 164 so as to project radially from an end edge 194 of the main body 100 of the insert 164, beyond the internal rib 184 and the radial rib 156. As such, in their radially projecting disposition, the tabs can define standoffs that limit radial displacement inwardly of the vane in the event of joint failure.

Figure 6:
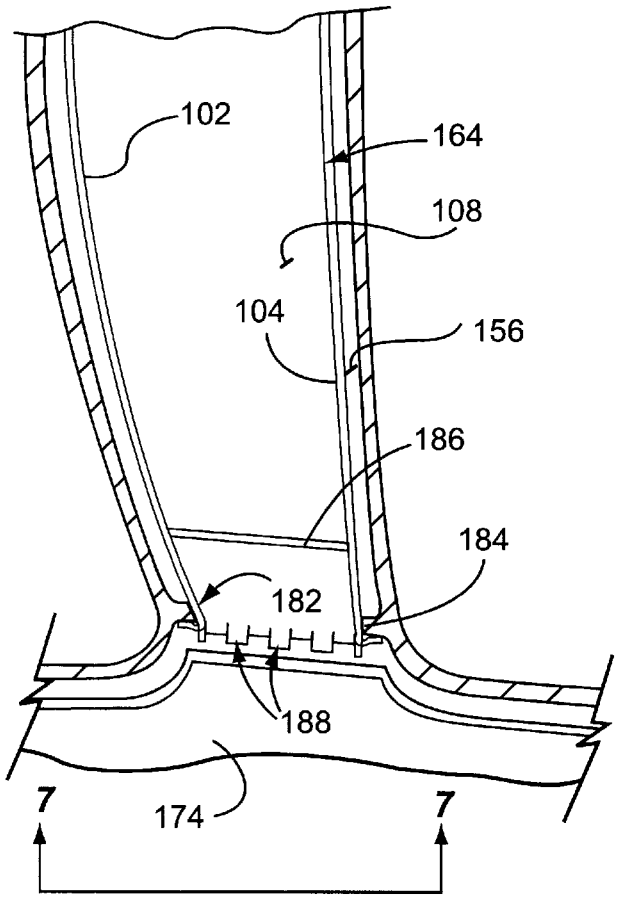
FIG. 6 is a schematic cross sectional view showing an impingement insert retained in a nozzle cavity as an embodiment of the invention.
Figure 7:
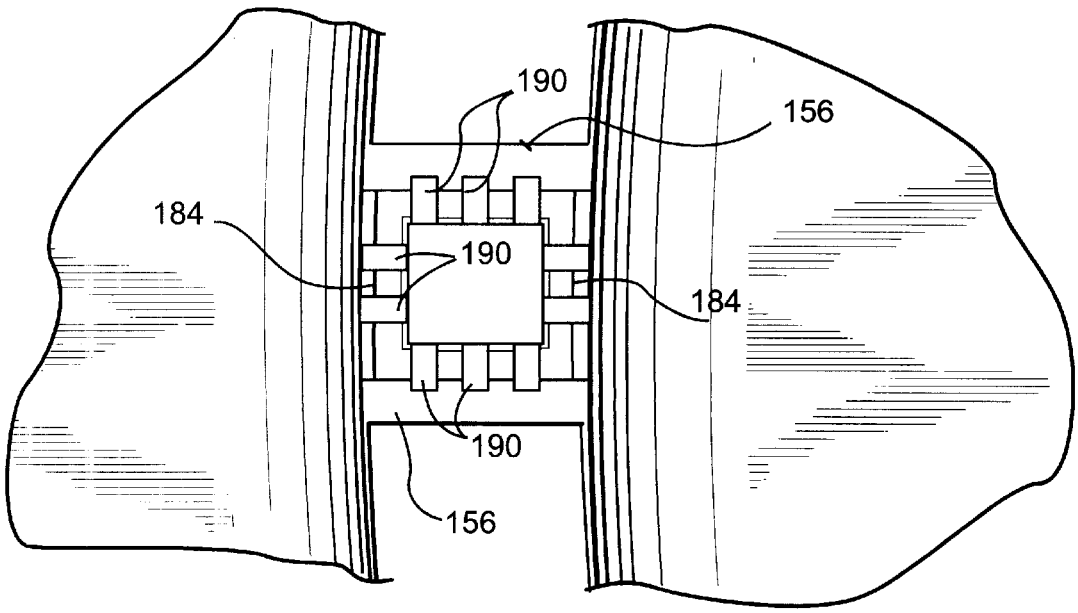
FIG. 7 is a schematic end view taken along line 7—7 of FIG. 6, with the impingement plate omitted for clarity.
Figure 8:
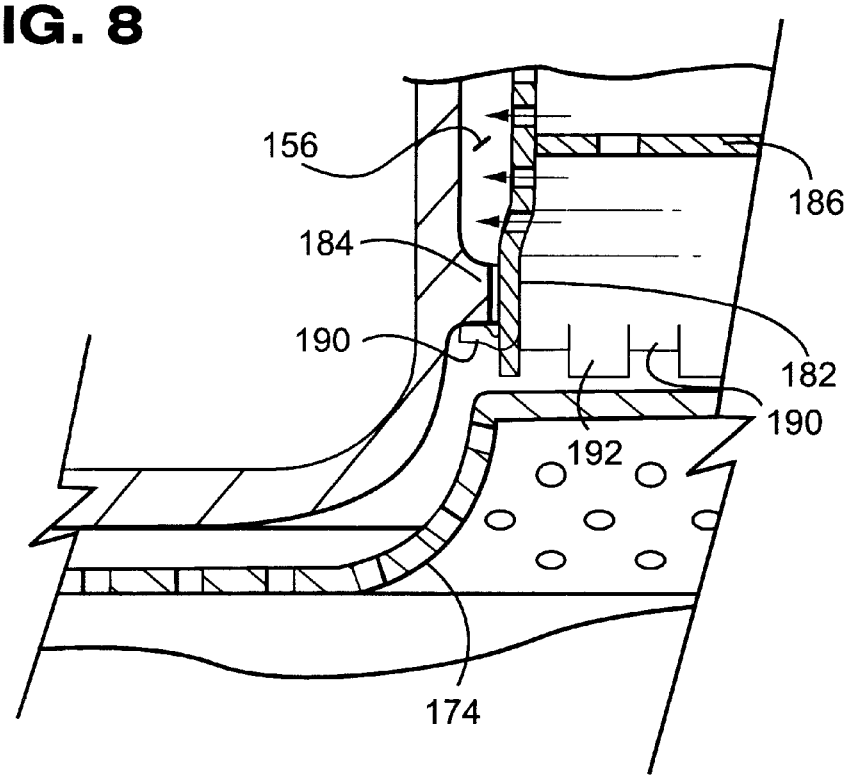
FIG. 8 is a schematic cross-sectional view illustrating the insert/nozzle connection detail of the embodiment of FIG. 5.

As shown in FIGS. 6–8, at least one of the tabs can be displaced with respect to the longitudinal axis of the insert following insertion of the insert structure, to define a retention tab 190. In the illustrated embodiment, the tabs are defined on respectively opposite sides of the insert, so that displacement of at least one tab on each side to an orientation generally perpendicular to the axis of the insert radially locks the insert with respect to the internal rib 184 and radial rib 156 so as to preclude movement of the insert 164 in the radial direction, outwardly in the configuration shown in FIGS. 6 and 8. If desired, the thus formed retention tabs 190 may be brazed to the internal rib 184 and/or radial rib 156. As illustrated, the retention/bent-over tabs 190 may be provided to overlie the radial rib 156 and/or the internal rib 184. It is preferred, however, that the retention tabs 190 be provided only at the radial rib locations for improved cooling, such as to maintain unobstructed cooling of the internal rib connection.

Thus, in the embodiment of FIGS. 4–8, at least one and preferably a plurality of fail-safe tabs 188 are defined or provided on opposing walls of at least one longitudinal end 182 of the insert 164. Advantageously, to provide a radial retention function, at least one of the tabs is disposed, or bent to be disposed, in an orientation generally perpendicular to the axis of the insert to define a retention tab 190. When a standoff function is desired, in addition or in the alternative, at least one of the tabs 188 is maintained in a radially extending orientation. Accordingly, in this embodiment, the tabs 188 that are not bent over define standoffs 192. To minimize cooling flow obstruction while providing a displacement limiting function, the standoff tab(s) of the insert are sized and disposed to terminate just short of contact with the adjacent impingement plate 174 or cover, as applicable.

The tab(s) that define the retention tab(s) 190 and/or standoff(s) 192 may be defined to extend along a portion or an entire dimension of the respective wall of the insert. As noted above, the tabs are preferably provided on opposing sides of the insert, the perforated sides 102, 104 and/or the non-perforated sides 106,108, depending upon whether retention tabs are provided, and whether they are provided to overlie the internal rib 184 and/or the radial rib 156. Thus, as illustrated in FIG. 4, on each side, one or more tabs may be defined and/or the tab(s) may extend along a part or an entire axial dimension of the insert. In FIG. 4 the tabs are illustrated as defined by spaced cuts 187 in the insert walls. However, in the alternative cutout(s) can be made so that the tabs are spaced apart along the respective wall. Also, in addition or in the alternative, the cuts between tabs and/or the tabs can be shaped to provide a desired tab or cutout configuration. For example, the cut between tabs can define a V-shaped notch (not shown) to facilitate subsequent independent displacement of the tabs to form retention tabs. In the alternative, as illustrated in FIG. 5, the tabs 388 may be, e.g., T-shaped to facilitate bending to a retention tab disposition while maximizing retention. Other shapes and configurations of cuts 187 and tabs 188 may be provided to achieve the desired retention frequency and to facilitate manufacture and assembly.

If retention tabs and/or standoffs are not provided at both ends of the insert, then advantageously both retention tabs 190 and/or standoffs 192, as illustrated in FIGS. 6–8, are used at one end only. In that regard, the retention tabs 190 are thus adapted to prevent the insert from becoming disengaged from the nozzle internal rib and/or radial rib interface in the event of internal rib joint failure and shifting radially in one direction, outwardly in the illustrated embodiment. The radial tabs or standoffs 192, on the other hand, prevent the insert from shifting substantially radially in the opposite direction, inwardly in the illustrated embodiment, in the event of joint failure. Thus, providing both radial tabs or standoffs and retention tabs at one end of the insert effectively provides mechanical limits for insert shifting. In the event retention tabs 190 are defined at each end of the insert, then the radial tabs or standoffs 192 may be omitted. As an alternative, radial tabs or standoffs 192 may be provided at both ends of the insert to limit movement of the insert relative to the inner and outer impingement plates, and the retention tabs 190 omitted.

Figure 9:
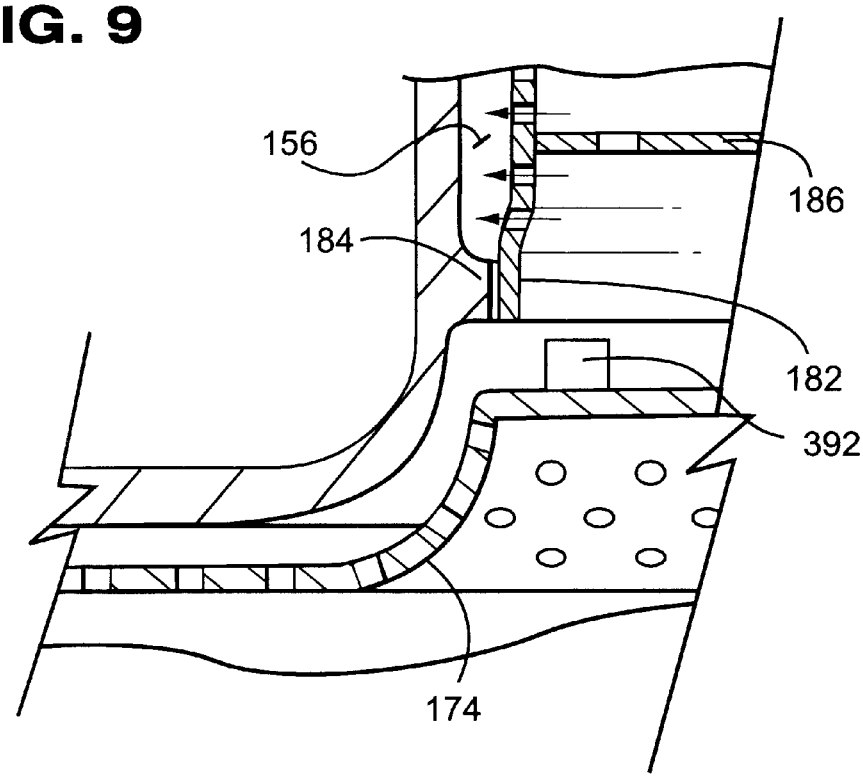
FIG. 9 is a schematic cross-sectional view of an insert/nozzle connection illustrating an alternate fail-safe tab placement.

As illustrated in FIG. 9, in addition or in the alternative to standoffs 192 provided as an integral part of the insert structure, standoffs 392 may be provided to extend off of the adjacent nozzle sidewall cover or impingement plate 174, if provided. As will be understood, such standoffs 392 are advantageously disposed to be aligned with insert wall(s), preferably opposed pairs of insert walls to provided a balanced standoff function in the event of flash joint failure.

Should the insert to nozzle joint fail during engine operation, the fail-safe tabs described above prevent the insert from being substantially disengaged from the nozzle/rib interface. This allows continued operation of the engine, albeit with slightly reduced cooling effectiveness due to the cooling bypass through the gap of the failed joint. If no retention and/or standoff structure were in place, the insert would be short circuited by the cooling flow and the nozzle would likely overheat causing a premature engine shutdown.

Figure 10:
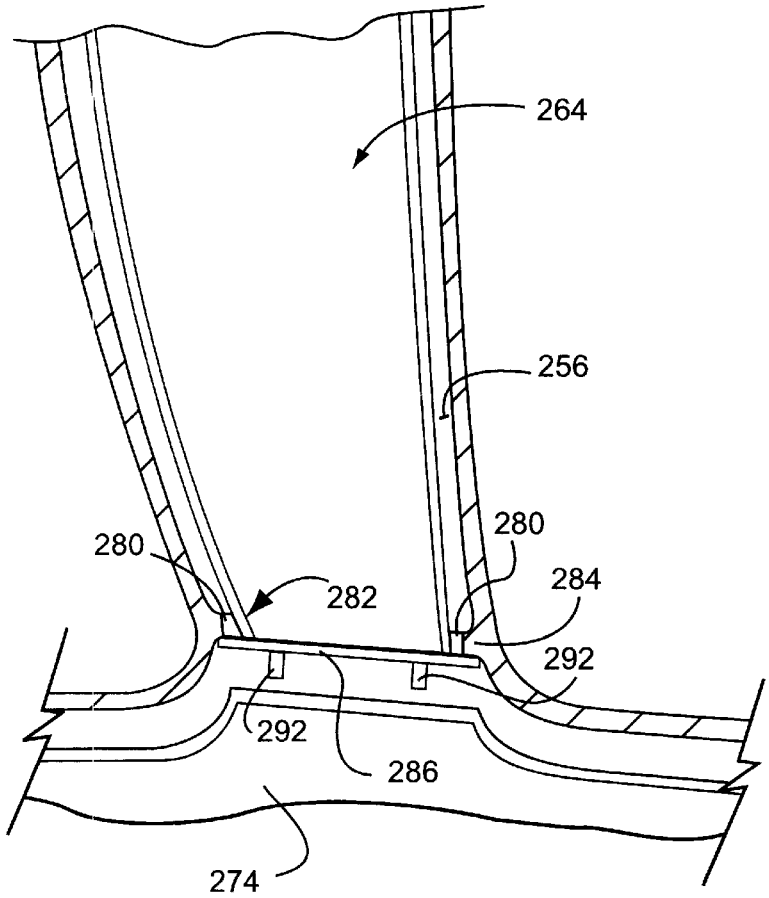
FIG. 10 is a schematic cross sectional view showing an impingement insert retained in a nozzle cavity with a metering plate as a second embodiment of the invention.
Figure 11:
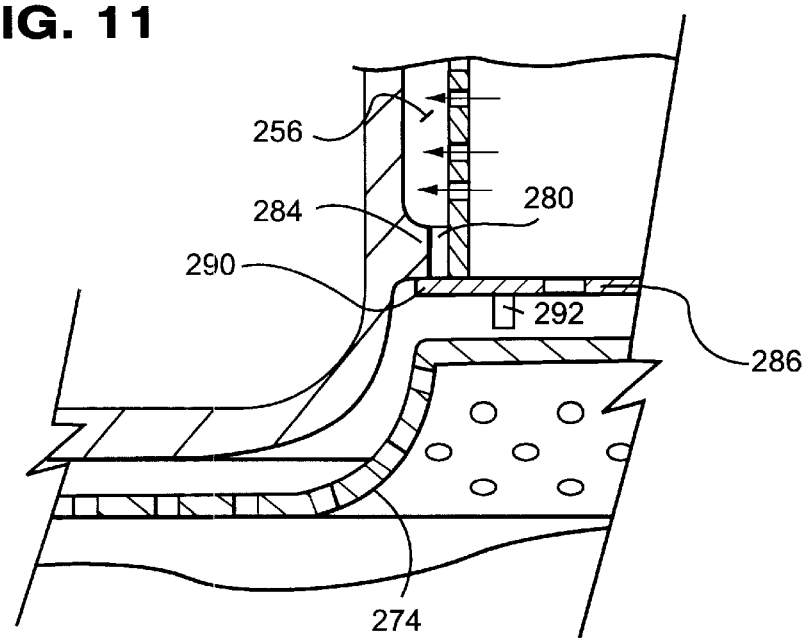
FIG. 11 is a schematic cross-sectional view illustrating the insert/nozzle/metering plate connection detail of the embodiment of FIG. 7.

As illustrated in FIGS. 10–11, in another embodiment of the invention, a system configuration is provided having an end mounted metering plate 286. In this embodiment, at least a portion of the metering plate 286 may be configured to project laterally beyond the wall of the insert and collar 280 mounted thereto, so as to overlie the internal rib 284 and/or the radial rib 256 to thus define a fail-safe tab, and more specifically a retention tab 290, to limit movement of the insert 264 in a radial direction, outwardly in the illustrated embodiment. Thus, the projecting portion 290 of the metering plate functions in a manner similar to the bent-over, retention tab(s) 190 of the first embodiment. In the event a projecting portion of a metering plate is disposed to overlie the internal rib and/or radial rib at only one end of the nozzle, advantageously inboard radial standoffs 292 are also provided, as illustrated, for interfacing with the adjacent impingement plate 274 or cover to limit radial movement of the insert, inwardly in the illustrated embodiment. Thus, the inboard radial standoff(s) 292 function in a manner similar to the radial tab(s) or standoff(s) 192 of the first embodiment. Furthermore, although not illustrated in FIG. 11, standoffs may be provided in addition or in the alternative extending from the impingement plate 274, in a manner similar to standoffs 392 shown in FIG. 9. In this embodiment, however, the standoffs would not be confined to correspond to the insert walls, because they would be adapted to abut the metering plate 286.

While the invention has been described in connection with what is presently considered to be the most practical and preferred embodiment, it is to be understood that the invention is not to be limited to the disclosed embodiment, but on the contrary, is intended to cover various modifications and equivalent arrangements included within the spirit and scope of the appended claims.

What is claimed is:

1. A turbine vane stator segment, comprising:

inner and outer walls spaced from one another;

a vane extending between said inner and outer walls and having leading and trailing edges, said vane including a plurality of discrete cavities between the leading and trailing edges and extending lengthwise of said vane for flowing a cooling medium;

an insert sleeve within one said cavity and spaced from interior wall surfaces thereof, said insert sleeve having an inlet end through which cooling medium flows into the insert sleeve, said insert sleeve having a plurality of openings therethrough for flowing the cooling medium through said openings into the space between said sleeve and said interior wall surfaces for impingement against said interior wall surfaces of said vane; and a plurality of first tabs defined at at least one longitudinal end of the insert for limiting radial displacement of the insert with respect to the vane, wherein said first tabs are disposed on said insert and extend in a radial direction, generally parallel to a longitudinal axis of the insert, for abutting a component facing thereto to limit radial displacement of the insert.

2. A turbine stator vane segment as in claim 1, further comprising a plurality of second tabs disposed on said insert and projecting in a direction generally transverse to a longitudinal axis of the insert for engaging a radial face of a wall of said cavity to limit radial displacement of the insert.

3. A turbine stator vane segment as in claim 2, wherein said radial face is a radial face of an internal rib defined on said wall.

4. A turbine stator vane segment as in claim 3, wherein said second tabs are mechanically secured to the internal rib.

5. A turbine stator vane segment as in claim 2, wherein said second tabs are mechanically secured to said wall of said cavity.

6. A turbine stator vane segment as in claim 3, wherein said second tabs are formed by a part of said insert and are distorted with respect to a plane of a wall of the insert to define retention tabs for engaging a radial face of a wall of said cavity to limit radial displacement of the insert.

7. A turbine stator vane segment as in claim 6, wherein said retention tabs are mechanically secured to said wall.

8. A turbine vane segment as in claim 7, wherein said wall is a radial wall disposed between adjacent cavities of said vane.

9. A turbine stator vane segment as in claim 6, wherein said retention tabs are mechanically secured to an internal rib defined on said wall.

10. A turbine stator vane segment as in claim 9, wherein the retention tabs are brazed to the internal rib.

11. A turbine vane segment as in claim 1, further comprising an internal rib defined about at least a portion of the periphery of said vane adjacent said inlet end of said insert sleeve, said insert sleeve being secured at said inlet end thereof to said internal rib.

12. A turbine stator vane segment as in claim 1, wherein said impingement holes are defined in first and second walls of the insert sleeve that face, respectively, pressure and suction sides of the vane.

13. A turbine stator vane segment as in claim 1, wherein said insert is disposed in an intermediate cavity of said vane through which cooling medium flows from said inner wall towards said outer wall.

14. A turbine vane segment, comprising:

inner and outer walls spaced from one another;

a vane extending between said inner and outer walls and having leading and trailing edges, said vane including a plurality of discrete cavities between the leading and trailing edges and extending lengthwise of said vane for flowing a cooling medium;

an insert sleeve within one said cavity and spaced from interior wall surfaces thereof, said insert sleeve having an inlet end through which cooling medium flows into the insert sleeve, said insert sleeve having a plurality of openings therethrough for flowing the cooling medium through said openings into the space between said sleeve and said interior wall surfaces for impingement against said interior wall surfaces of said vane; and at least one tab defined at at least one longitudinal end of the insert for limiting radial displacement of the insert with respect to the vane, wherein said at least one tab is defined by an outer peripheral edge of a metering plate mounted to the respective end of the insert.

15. A turbine vane segment, comprising:

inner and outer walls spaced from one another;

a vane extending between said inner and outer walls and having leading and trailing edges, said vane including a plurality of discrete cavities between the leading and trailing edges and extending lengthwise of said vane for flowing a cooling medium;

an insert sleeve within one said cavity and spaced from interior wall surfaces thereof, said insert sleeve having an inlet end through which cooling medium flows into the insert sleeve, said insert sleeve having a plurality of openings therethrough for flowing the cooling medium through said openings into the space between said sleeve and said interior wall surfaces for impingement against said interior wall surfaces of said vane; and at least one tab defined at at least one longitudinal end of the insert for limiting radial displacement of the insert with respect to the vane, wherein said at least one tab is disposed on a component facing said inlet end of said insert, and extends from said component in a radial direction, generally parallel to a longitudinal axis of the insert, for selectively abutting a wall of said insert to limit radial displacement of the insert.

16. A turbine vane segment as in claim 15, wherein said component is an impingement plate disposed to overlie said inner wall of said vane.

17. An impingement insert sleeve for being disposed in a coolant cavity defined through a stator vane, having a generally open inlet end and first and second pairs of diametrically opposed side walls, and having a plurality of tabs defined at said inlet end for limiting radial displacement of the insert with respect to the stator vane, wherein at least one of said tabs extends in a radial direction from an end edge of a main body of said insert, generally parallel to a longitudinal axis of the insert, for abutting a component facing thereto to limit radial displacement of the insert.

18. An impingement insert sleeve as in claim 17, wherein at least one of said tabs projects in a direction generally transverse to the longitudinal axis of the insert.

19. An impingement insert sleeve as in claim 18, wherein said at least one transversely projecting tab is formed as a part of at least one of said sidewalls and is distorted with respect to a plane of said at least one sidewall to define a bentover, retention tab.

20. A turbine vane segment, comprising:

inner and outer walls spaced from one another;

a vane extending between said inner and outer walls and having leading and trailing edges, said vane including a plurality of discrete cavities between the leading and trailing edges and extending lengthwise of said vane for flowing a cooling medium;

an insert sleeve within one said cavity and spaced from interior wall surfaces thereof, said insert sleeve having an inlet end through which cooling medium flows into the insert sleeve, said insert sleeve having a plurality of openings therethrough for flowing the cooling medium through said openings into the space between said sleeve and said interior wall surfaces for impingement against said interior wall surfaces of said vane;

an internal rib being defined about at least a portion of a periphery of said cavity, said insert being mounted to said internal rib by a braze or weld joint; and a metering plate having at least one opening for cooling medium flow defined therethrough, said metering plate being mounted to said inlet end of said insert sleeve and projecting laterally beyond an outer periphery of said insert so as to at least partially overlie said internal rib, whereby radial displacement of said insert with respect to said vane in the event of joint failure is limited.

21. A turbine vane segment as in claim 20, wherein there are a plurality of flow openings defined through said metering plate.

22. A turbine vane segment as in claim 20, further comprising at least one standoff tab projecting radially from a surface of said metering plate, for abutting engagement with an adjacent structure to limit radial displacement of the insert sleeve.

23. An impingement insert sleeve for being disposed in a coolant cavity defined through a stator vane, having an inlet end, first and second pairs of diametrically opposed side walls, a collar mounted to said inlet end, and a metering plate having at least one opening for cooling medium flow defined therethrough, said metering plate being mounted to said inlet end of said insert sleeve and including a portion projecting laterally beyond an outer periphery of said insert and said collar.

24. An impingement insert sleeve as in claim 23, further comprising at least one standoff tab projecting radially from a surface of said metering plate, for abutting engagement with an adjacent structure to limit radial displacement of the insert sleeve.

* * * * *